US011081780B2

(12) United States Patent
Yang et al.

(10) Patent No.: US 11,081,780 B2
(45) Date of Patent: Aug. 3, 2021

(54) MULTI-BAND ANTENNA ARCHITECTURE

(71) Applicants: Electric Connector Technology Co., Ltd., Shenzhen (CN); Shanghai University, Shanghai (CN)

(72) Inventors: Guangli Yang, Shenzhen (CN); Mingkai Wang, Shanghai (CN); Jiayou Xu, Shanghai (CN); Yong Luo, Shanghai (CN); YiXin Li, Shanghai (CN); Yun Luo, Shenzhen (CN); Tao Zhang, Shenzhen (CN); Yingjie Zhang, Shenzhen (CN); Eugene Yu-Jiun Ren, Shenzhen (CN)

(73) Assignee: Electric Connector Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/831,333

(22) Filed: Mar. 26, 2020

(65) Prior Publication Data

US 2020/0313283 A1 Oct. 1, 2020

(30) Foreign Application Priority Data

Mar. 28, 2019 (CN) ..... 201910242547.5

(51) Int. Cl.
*H01Q 1/24* (2006.01)
*H01Q 7/00* (2006.01)
*H01Q 5/30* (2015.01)

(52) U.S. Cl.
CPC ..... *H01Q 1/243* (2013.01); *H01Q 5/30* (2015.01); *H01Q 7/00* (2013.01)

(58) Field of Classification Search
CPC ..... H01Q 1/24; H01Q 1/241; H01Q 1/243; H01Q 5/30; H01Q 7/00; H01Q 21/26; H01Q 21/28; H01Q 5/40
See application file for complete search history.

(56) References Cited

U.S. PATENT DOCUMENTS 8,354,972 B2 * 1/2013 Borja ..... H01Q 5/378 343/797
2013/0285852 A1 * 10/2013 Teillet ..... H01Q 3/38 342/368
2014/0203995 A1 * 7/2014 Romney ..... H01Q 21/065 343/893
2014/0375502 A1 * 12/2014 Foo ..... H01Q 5/40 342/371
2017/0271764 A1 * 9/2017 Gabriel ..... H01Q 5/40

* cited by examiner

*Primary Examiner* — Thai Pham

(57) ABSTRACT

Disclosed is a multi-band antenna architecture, provided in a matrix of a wireless communication device, including: a first antenna, typically an LTE antenna, located in left outer side and right outer side areas of the matrix, a second antenna, typically a Sub-6 GHz MIMO antenna, located in upper outer side and lower outer side areas of the matrix, and a third antenna, typically a millimeter-wave antenna, located in left inner side and right inner side areas of the matrix. The above-mentioned areas are spaced from each other. The first antenna, the second antenna, and the third antenna work at different frequency bands. The third antenna can implement broadband and large-angle beam scanning.

15 Claims, 1 Drawing Sheet

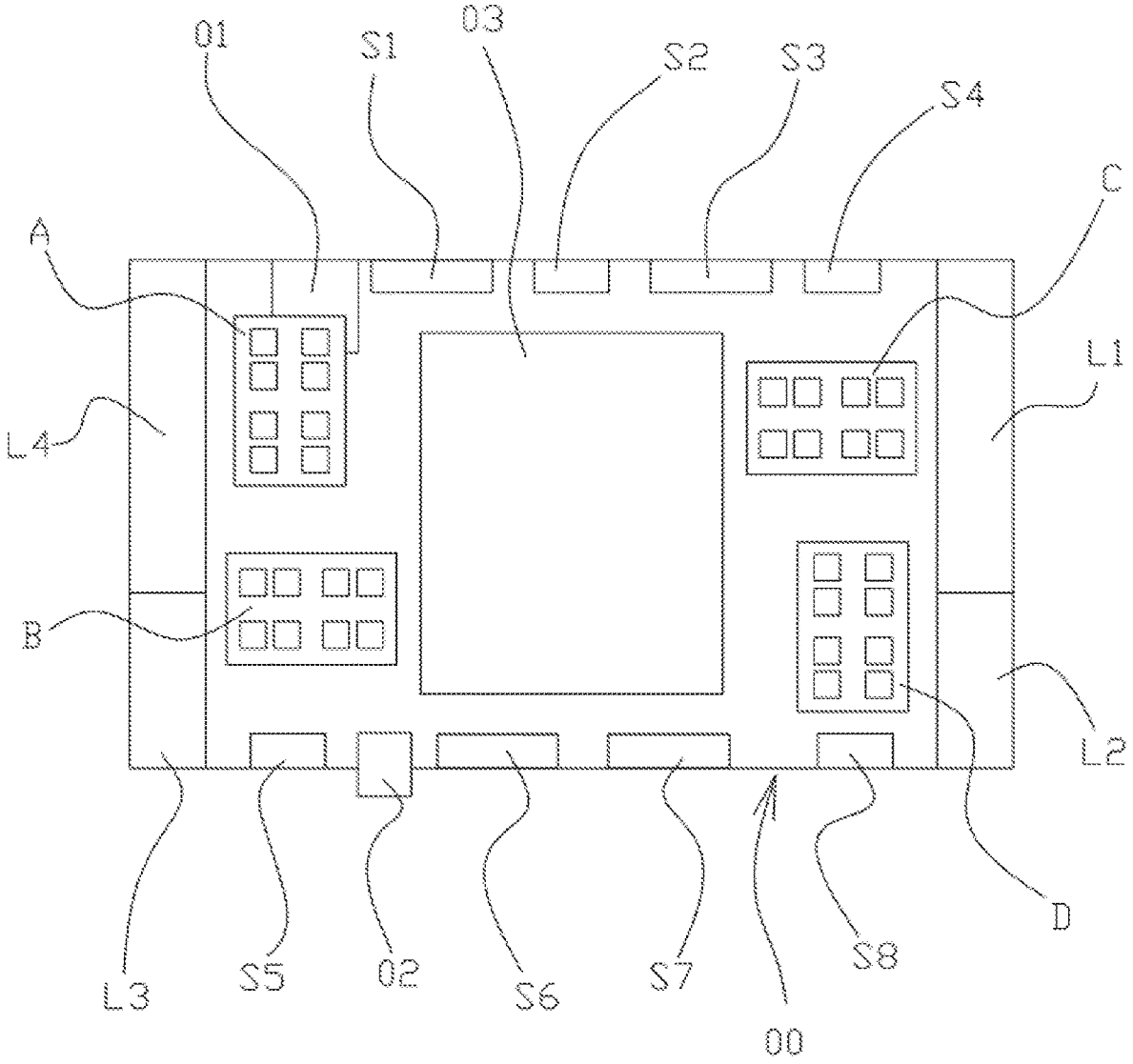
01
S1
03
S2
S3
S4
C
A
L1
L4
B
L2
D
L3
S5
02
S6
S7
S8
00

MULTI-BAND ANTENNA ARCHITECTURE

CROSS-REFERENCE TO RELATED APPLICATIONS

The present application claims the priority of the Chinese Patent Application No. 201910242547.5, filed on Mar. 28, 2019 and titled MULTI-BAND ANTENNA ARCHITECTURE, and the content of which is incorporated by reference herein in its entirety, the specification of which is incorporated by reference herein in its entirety.

TECHNICAL FIELD

The present disclosure relates to the field of antenna technology, and particularly to an antenna architecture for multi-band wireless communication of a mobile communication device.

BACKGROUND

With the advent of the age of 5G communication, the antennas of the wireless communication devices tend to develop from a single-band antenna to a multi-band antenna, and multiple antennas at different frequency bands often need to be designed and arranged in a limited space. For example, for the 5G (fifth generation mobile communication technology) mobile terminals, multiple antennas at different frequency bands such as sub-6 GHz MIMO, LTE, WIFI, GPS, millimeter wave antennas, etc. often need to be designed and arranged in a limited space to implement multiple functions.

SUMMARY

A multi-band antenna architecture, provided in a matrix of a wireless communication device, includes: a first antenna, located in a left outer side area and a right outer side area of the matrix; a second antenna, located in an upper outer side area and a lower outer side area of the matrix; a third antenna, located in a left inner side area and a right inner side area of the matrix; the left outer side area, the right outer side area, the upper outer side area, the lower outer side area, the left inner side area and the right inner side area spaced from each other; the first antenna, the second antenna and the third antenna working at different frequency bands, and the third antenna capable of implementing broadband and large-angle beam scanning.

BRIEF DESCRIPTION OF THE DRAWINGS

FIG. 1 is a schematic structure diagram illustrating a multi-band antenna architecture according to an embodiment of the present invention.

DETAILED DESCRIPTION

In order to make the objectives, technical solutions, and advantages of the present disclosure clearer, the present disclosure will be detailed through embodiments with reference to the accompanying drawings. It should be appreciated that the specific embodiments described herein are only used for explanation of the disclosure, and are not intended to limit the disclosure. The wireless communication device may be an electronic device with a communication function, such as a mobile phone, a tablet computer, a notebook computer, and a dual-screen tablet computer, etc.

It should be noted that the terms "left outer side", "right outer side", "left inner side", "right inner side", "middle area" and the "upper end portion" and "lower end portion" of each area are merely provided for reference of relative positions of these orientations, not for limiting the positions.

At present, in most antenna designs, the multi-unit sub-6 GHz MIMO antenna is placed on the side of wireless communication device (such as the 5G mobile phones, etc.). In some other designs, the 5G millimeter-wave antenna is also placed on the side of the wireless communication device. These designs are proposed from a single antenna, which lack overall consideration, and do not consider the rationality of the arrangement from the overall arrangement when multiple antennas at different frequency bands coexist, and do not consider the different characteristics of the LTE main antenna, sub-6 GHz MIMO antenna, and millimeter-wave antenna, accordingly, the problem of the isolation between antenna units cannot be solved, especially the problem of the isolation between the LTE main antenna and the sub-6 GHz MIMO antenna, as a result, antenna signals at different frequency bands often interfere with each other in the use of wireless communication devices, which causes a decrease in the communication efficiency, and brings inconvenience to the user. Therefore, it is urgent to develop an antenna architecture with overall reasonable arrangement which can overcome the above defects and meet the multi-function requirement of the coexistence of multiple antennas at different frequency bands.

Referring to FIG. 1, which shows a schematic structure diagram illustrating a multi-band antenna architecture provided by the present disclosure. The multi-band antenna architecture shown is an antenna architecture solution in a typical 5.7-inch mobile phone model and compatible with the designs of the LTE antenna, sub-6 GHz MIMO antenna and millimeter-wave MIMO antenna which work at different frequency bands. Note that the antenna architecture described herein can be, but is not limited to, multi-band antennas used in the 4G and 5G communications. In addition, LTE described herein is defined as frequency bands used for the LTE communication, and these frequency bands are used in the fourth generation (4G) and the fifth generation (5G) communication systems.

As shown in FIG. 1, a multi-band antenna architecture according to an embodiment of the present invention is provided in a matrix 00 of the wireless communication device. The matrix 00 is divided into five areas in a left-to-right order from the perspective of projection to the interior, a left outer side area, a left inner side area, a middle area, a right outer side area, and a right inner side area; and the matrix 00 is divided into three areas from top to bottom, an upper outer side area, a middle area and a lower outer side area. The above seven areas in all are spaced and independent of each other. The multi-band antenna architecture includes a first antenna L1/L2/L3/L4, a second antenna S1/S2/S3/S4/S5/S6/S7/S8 and a third antenna A/B/C/D. The first antenna is an LTE multi-unit antenna (having four antenna units here) to cover all wave bands of the 4G or 5G; the second antenna is a sub-6 ghz MIMO multi-unit antenna (having eight antenna units here) to cover medium and low wave bands of the 5G; and the third antenna is a millimeter-wave MIMO antenna (having 8 units here) to cover a millimeter-wave band of the 5G.

The above term "multi-unit" refers to more than two (including two) units. The number of antenna units is not limited, but is subject to the design requirement of the wireless communication device or the space.

Referring to FIG. 1, the first antenna L1/L2/L3/L4 is located in the left outer side area and the right outer side area of the matrix 00. Furthermore, the first antenna L1 is located in the upper end portion area of the right outer side area, the first antenna L4 is located in the upper end portion area of the left outer side area, the first antennas L1 and L4 are both configured to radiate the LTE main antenna. In the present embodiment, an antenna type of L1 and L4 is a chip low frequency adjustable Loop antenna including a low frequency band covering portion and a high frequency band covering portion. A frequency range of the low frequency band is 700 to 960 MHz, and a frequency range of the high frequency band is 1710 to 2690 MHz. The low frequency band covering portion tunes a radiation coverage by changing the value of the grounded inductor via an RF switch (not shown, i.e., a transferring switch which can implement the switching of an RF signal path of a circuit). The high frequency band covering portion implements the radiation coverage by using the high order mode of Loop antenna. Furthermore, the first antenna L2 is located in the lower end portion area of the right outer side area; the first antenna L3 is located in the lower end portion area of the left outer side area; the first antennas L2 and L3 are both used as an LTE auxiliary antenna, and, of course, can also be used as the LTE main antenna. In the present embodiment, the antenna type of the first antennas L2 and L3 is a double-branch inverted F antenna, and has a high frequency band covering portion with a working frequency band of 1710 to 2690 MHZ. Here, ground connection points of L1/L2 and L3/L4 antennas can be designed as an adjacent arrangement. In this way, the coupling degree between adjacent first antennas with different types can be effectively reduced. At the same time, the first antennas L1 and L4 are arranged on the same side of the upper and lower ends of the matrix 00, as a result, the isolation of the antenna at the low frequency band can be improved, such that the isolation can meet the design requirement of greater than −10 dB, so as to obtain a better isolation.

Referring to FIG. 1, in the present embodiment, the second antenna has eight antenna units and is configured to radiate a sub-6 GHz MIMO signal. The second antennas are defined into two groups according to two different antenna types employed, in which the second antennas S1, S3, S6, and S7 are Loop antennas, and have the working frequency ranges from 2496 to 2690 MHz and from 3400 to 3800 MHz which can be adjusted by modifying the shape of the Loop branch, and the covered frequency band meets the existing CA standard. The second antennas S2, S4, S5, and S8 are a planar inverted F antenna, and have a working frequency range from 3400 to 3800 MHz. Such side conformal planar inverted F antenna structure can cover a wider bandwidth while reducing the space taken up by the antenna. In addition, better isolation can be obtained by adjusting the distance between the planar inverted F antenna group and the Loop antenna group and adjusting an arrangement and combination mode of the planar inverted F antenna group and the Loop antenna group.

From FIG. 1, it is apparent that the second antennas S1 and S3 of the Loop antenna type and the second antennas S2 and S4 of the planar inverted F antenna type are arranged on the upper outer side area of the matrix 00 in a row in an alternatively arranging manner. The upper outer side area is further provided with a SIM card 01 (of course, may be provided with other functional components such as a memory card). In the lower end portion area, the second antennas S5, S6, S7 and S8 are arranged sequentially in a row from left to right, in this way, the planar inverted F antenna group is arranged on both sides of the Loop antenna group, such that the Loop-type second antennas S6 and S7 are placed adjacent to each other to improve the isolation. In addition, as shown in FIG. 1, a side button 02 is further provided at a position in the lower end portion area.

In the above arrangement design, the Loop type of antennas S1, S3, S6, and S7 are arranged in the middle areas of the upper and lower side frames, because the Loop-type antenna excites the LTE band of 2496 to 2690 MHz, and has a shared wave band with the first antennas L1/L4 and L2/L3. The Loop-type antennas S1, S3, S6, and S7 are placed away from the upper and lower sides, which is conducive to improve the isolation between the antenna S1/S3/S6/S7 and the LTE antenna. In addition, since the SIM card 01 occupies a certain space of the frame, the antenna unit on one side of the SIM card 01 located on the upper side employs a planar inverted F antenna with a smaller dimension (or called an IFA antenna), and the planar inverted F antenna and the Loop-type antenna are alternatively arranged in a row, thereby further improving the isolation between the corresponding antennas. For the antennas on the lower side where the side button 02 is located, the Loop-type second antennas S6 and S7 are arranged adjacent to each other, and the balanced mode of the Loop-type antenna is excited at the same time, such that the isolation between antennas meets the design requirement. Specifically, the isolation between the first antenna and the second antenna is greater than −10 dB.

As shown in FIG. 1, the third antennas A, B, C and D are configured to the radiate millimeter-wave signal, and have a working frequency range from 24 to 40 GHz. Through a reasonable arrangement, for example, two third antennas in two adjacent areas are arranged perpendicular to each other by using a modular polarization diversity scheme. The third antenna includes multiple antenna radiation units each of which has a single row and multiple columns or multiple rows and a single column, which can implement the broadband and large-angle beam scanning. Specifically, in the present embodiment, the third antennas A, B, C, D are arranged in a 4×4 MIMO arrangement and combination mode, to arrange the upper and lower side portions in the left inner side area and the upper and lower side portions in the right inner side area as four spaced different areas. The third antenna A located in the upper side portion of the left inner side area and the third antenna D located in the lower side portion of the right inner side area are arranged in a vertical direction; while the third antenna B located in the lower side portion of the left inner side area and the third antenna C located in the upper side portion of the right inner side area are arranged in a horizontal direction, such that two third antennas on the same side are arranged perpendicular to each other, so as to broaden the space angle of the radiation, meanwhile improve the isolation of the third antenna from the first antenna or the second antenna in an adjacent area.

The polarization diversity scheme is employed because one millimeter-wave antenna module can only perform the beam scanning in one dimension, and the antenna arrays of two millimeter-wave modules are placed perpendicular to each other, such that the two millimeter-wave modules can respectively implement the beam scanning in different dimensions, thereby increasing the beam coverage of the millimeter-wave modules of the MIMO array. At the same time, the polarization directions of the antenna arrays are perpendicular to each other, which enables the millimeter-wave modules of the MIMO array to receive electromagnetic waves of two polarization directions, thereby enhancing the signal receiving capability.

Referring to FIG. 1, a battery 03 is further included, which is located in a middle area between the left inner side area and the right inner side area of the matrix 00 to provide a power supply.

In summary, the multi-band antenna architecture of the present disclosure is easy to integrate, and has excellent radiation and good isolation, and can achieve the following technical effects:

1) Through the reasonable arrangement of the LTE antenna belonging to the first antenna and the sub-6 GHz MIMO antenna belonging to the second antenna and the selection of the frequency band combination, such that the overall isolation is greater than −10 dB, which effectively solves the problems of arrangement and frequency band selection of multiple antenna units under 6 GHz.

2) The millimeter-wave antenna belonging to the third antenna is modularized and arranged in a polarization diversity mode, such that the interaction among the millimeter-wave antenna, the sub-6 GHz antenna and the LTE antenna is less, thereby implementing a good overall performance and solving the design problem of coexistence of multiple forms of antennas in the future (such as the 5G communication) from the overall architecture.

Of course, it is worth noting that, in other embodiments, the number and type/form of the first antenna and the second antenna can be changed as long as the frequency band and the position of the arrangement are unchanged, or the number of modules of the third antenna can be changed as long as the arrangement in which the third antennas on the same side are perpendicular to each other is unchanged, which is not limited by the present disclosure.

According to the multi-band antenna architecture of the present disclosure, multiple antennas at different frequency bands can coexist in a limited space at the same time without interference affecting the use function. Furthermore, in terms of the coexistence of LTE antennas, sub-6 GHz MIMO antennas and millimeter-wave antennas, multiple antenna units operating under 6 GHz can effectively coexist without affecting the position arrangement of the millimeter-wave antenna through the selection of different frequency bands and corresponding antenna types, and a reasonable antenna system architecture of a wireless communication device (such as the 5G mobile phone) is provided from an overall perspective. In addition, the millimeter-wave antenna is modularized, such that the millimeter-wave antenna and other antennas can be effectively arranged in a limited space, and the design problem of coexistence of multiple forms of antennas in the future is solved in terms of an overall architecture.

The technical features in the above embodiments can be employed in arbitrary combinations. For purpose of simplifying the description, all possible combinations of the technical features in the above embodiments are not described herein. However, as long as there is no contradiction in the combinations of the technical features, they should be considered as within the scope of the disclosure.

The above embodiments are merely several exemplary embodiments of the disclosure, and the descriptions thereof are more specific and detailed, but should not be interpreted as limiting the scope of the present disclosure. It should be noted that a number of variations and improvements can be made by those skilled in the art without departing from the concept of the present disclosure, and which all fall within the scope of the present disclosure. Therefore, the scope of protection of the present disclosure should be subject to the appended claims.

What is claimed is:

1. A multi-band antenna architecture, provided in a matrix of a wireless communication devices, comprising:

a first antenna, located in a left outer side area and a right outer side area of the matrix;

a second antenna, located in an upper outer side area and a lower outer side area of the matrix; and a third antenna, located in a left inner side area and a right inner side area of the matrix;

wherein the left outer side area, the right outer side area, the upper outer side area, the lower outer side area, the left inner side area and the right inner side area are spaced from each other, the first antenna, the second antenna and the third antenna operate at different frequency bands, and the third antenna is capable of implementing broadband and large-angle beam scanning.

2. The multi-band antenna architecture according to claim 1, wherein, the first antenna is an LTE multi-unit MIMO antenna, the second antenna is a sub-6 ghz multi-unit MIMO antenna, and the third antenna is a millimeter-wave MIMO antenna.

3. The multi-band antenna architecture according to claim 2, wherein, the second antenna comprises a Loop antenna group and a planar inverted F antenna group, an antenna in the Loop antenna group and an antenna in the planar inverted F antenna group in the upper outer side area are alternatively arranged in a row, that is, two adjacent antennas belong to different antenna groups.

4. The multi-band antenna architecture according to claim 3, wherein, the planar inverted F antenna group located in the lower outer side area is arranged on both sides of the Loop antenna group.

5. The multi-band antenna architecture according to claim 3, wherein, working frequency ranges of the Loop antenna group is 2496 to 2690 MHz and 3400 to 3800 MHz, and can be extended by adjusting and optimizing a Loop branch.

6. The multi-band antenna architecture according to claim 3, wherein, a working frequency range of the planar inverted F antenna group is 3400 to 3800 MHz, a better isolation is obtained by adjusting a distance between the planar inverted F antenna group and the Loop antenna group and an arrangement and combination mode of the planar inverted F antenna group and the Loop antenna group.

7. The multi-band antenna architecture according to claim 2, wherein, a plurality of third antennas in adjacent two areas are arranged perpendicular to each other.

8. The multi-band antenna architecture according to claim 7, wherein, the plurality of third antennas are arranged in a 4×4 MIMO arrangement and combination mode.

9. The multi-band antenna architecture according to claim 8, wherein, an upper side portion and a lower side portion of the left inner side area, and an upper side portion and a lower side portion of the right inner side area are four spaced different areas, at least two of the third antennas respectively arranged in the four spaced different areas are perpendicular to each other, to broaden a space angle of radiation and improve isolation between the third antenna and a first antenna or a second antenna in an adjacent area.

10. The multi-band antenna architecture according to claim 9, wherein, a third antenna located in the upper side portion of the left inner side area and a third antenna located in the lower side portion of the right inner side area are arranged in a vertical direction; while a third antenna located in the lower side portion of the left inner side area and a third antenna located in the upper side portion of the right inner side area are arranged in a horizontal direction.

11. The multi-band antenna architecture according to claim 7, wherein, a working frequency range of the third antenna is 24 to 40 GHz.

12. The multi-band antenna architecture according to claim 1, wherein, an upper end portion of the first antenna located in the left outer side area and an upper end portion of the first antenna located in the right outer side area are defined as an LTE main antenna which comprises a low frequency band covering portion and a high frequency band covering portion, a frequency range of the low frequency band covering portion is 700 to 960 MHz, and a frequency range of the high frequency band covering portion is 1710 to 2690 MHz; the low frequency band covering portion tunes a radiation coverage by changing a value of a grounded inductor via a radio frequency switch, and the high frequency band covering portion implements a full coverage by using a high order mode of a Loop antenna.

13. The multi-band antenna architecture according to claim 12, wherein, a lower end portion of the first antenna located in the left outer side area and a lower end portion of the first antenna located in the right outer side portion are defined as an LTE auxiliary antenna having a high frequency band covering portion with a frequency range of 1710 to 2690 MHz, the LTE auxiliary antenna has a double-branch inverted F antenna structure, and ground connection points of the LTE main antenna and the LTE auxiliary antenna are adjacent, to reduce a coupling degree with an LTE MIMO antenna and obtain a better isolation.

14. The multi-band antenna architecture according to claim 1, wherein, an isolation between the first antenna and a second antenna is greater than −10 dB.

15. The multi-band antenna architecture according to claim 1, further comprising a battery located in a middle area between the left inner side area and the right inner side area of the matrix.

* * * * *